US009980620B2

(12) United States Patent
Sjöberg

(10) Patent No.: US 9,980,620 B2
(45) Date of Patent: May 29, 2018

(54) BAGLESS VACUUM CLEANER WITH FILTER CLEANING MEMBER

(71) Applicant: Aktiebolaget Electrolux, Stockholm (SE)

(72) Inventor: Fredrik Sjöberg, Stockholm (SE)

(73) Assignee: AKTIEBOLAGET ELECTROLUX, Stockholm (SE)

( * ) Notice: Subject to any disclaimer, the term of this patent is extended or adjusted under 35 U.S.C. 154(b) by 0 days. days.

(21) Appl. No.: 15/124,473

(22) PCT Filed: Mar. 12, 2014

(86) PCT No.: PCT/EP2014/054881
§ 371 (c)(1),
(2) Date: Sep. 8, 2016

(87) PCT Pub. No.: WO2015/135582
PCT Pub. Date: Sep. 17, 2015

(65) Prior Publication Data
US 2017/0020351 A1 Jan. 26, 2017

(51) Int. Cl.

| | |
|---|---|
| ***A47L 9/20*** | (2006.01) |
| ***A47L 5/24*** | (2006.01) |
| ***A47L 9/12*** | (2006.01) |
| ***A47L 9/16*** | (2006.01) |

(52) U.S. Cl.
CPC ..... *A47L 9/20* (2013.01); *A47L 5/24* (2013.01); *A47L 9/122* (2013.01); *A47L 9/1683* (2013.01)

(58) Field of Classification Search
CPC ... A47L 5/24; A47L 9/20; A47L 9/122; A47L 9/1683
USPC ..... 15/352
See application file for complete search history.

(56) References Cited

U.S. PATENT DOCUMENTS

2004/0177471 A1* 9/2004 Jung ..... A47L 9/1675 15/352
2008/0264007 A1 10/2008 Oh et al.
2010/0319307 A1* 12/2010 Kim ..... A47L 9/1666 55/301

FOREIGN PATENT DOCUMENTS

| | | |
|---|---|---|
| EP | 1523916 | 4/2005 |
| EP | 1745734 | 1/2007 |
| EP | 1955631 | 8/2008 |

OTHER PUBLICATIONS

International Search Report for PCT/EP2014/054881, dated Nov. 21, 2014, 2 pages.
International Preliminary Report on Patentability and Written Opinion for PCT/EP2014/054881, dated Sep. 13, 2016, 8 pages.

* cited by examiner

*Primary Examiner* — David Redding
(74) *Attorney, Agent, or Firm* — RatnerPrestia

(57) ABSTRACT

A bagless vacuum cleaner with a main housing, a dust bin releasable from the main housing upon relative movement between the dust bin and the main housing in a release direction, a filter unit, and at least one cleaning member arranged to perform a cleaning action on the filter unit upon relative movement between the at least one cleaning member and the filter unit. The relative movement between the filter unit and the at least one cleaning member is created by relative movement between the main housing and the dust bin in the release direction.

17 Claims, 5 Drawing Sheets

BAGLESS VACUUM CLEANER WITH FILTER CLEANING MEMBER

This application is a U.S. National Phase application of PCT International Application No. PCT/EP2014/054881 filed Mar. 12, 2014, which is incorporated by reference herein.

FIELD OF THE INVENTION

The present invention generally relates to the field of bagless vacuum cleaners. In particular, the present invention relates to such vacuum cleaners comprising a filter unit and means for cleaning the filter unit.

BACKGROUND OF THE INVENTION

A general issue with bagless vacuum cleaners is loss of suction force, which results in impaired cleaning performance. Bagless vacuum cleaners normally comprise a filter unit for filtering the airflow before/upon exit of the dust bin or dust separator. After some time of operation of the vacuum cleaner, the filter unit gets covered with dust, which increases the airflow resistance through the filter unit, whereby the airflow is reduced, which in turn reduces the suction force of the vacuum cleaner. In order to reduce the risk of low performance of bagless vacuum cleaners due to poor suction force, the filter unit needs to be cleaned regularly.

Various solutions exist for achieving cleaning of filter units for bagless vacuum cleaners. Most commonly, the filter unit must be removed from the vacuum cleaner and be manually cleaned with water. Such manual cleaning action may be cumbersome for the user and when it is finished, the filter unit must be dried in open air for about 24 hours, during which period the vacuum cleaner cannot be used.

US 20080264007 A1 shows a motor driven filter cleaning mechanism, which may be operated while the filter unit is positioned in the vacuum cleaner.

However, the motor driven filter cleaning mechanism must be switched on by the user, which implies a risk that it gets forgotten and therefore gets done too seldom resulting in an impaired suction force of the vacuum cleaner.

SUMMARY OF THE INVENTION

It would be advantageous to achieve a bagless vacuum cleaner overcoming, or at least alleviating, the above mentioned drawbacks. In particular, it would be desirable to enable a bagless vacuum cleaner with a reduced risk of low performance due to impaired suction force.

To better address one or more of these concerns, a bagless vacuum cleaner having the features defined in the independent claim is provided. Preferable embodiments are defined in the dependent claims.

Hence, according to an aspect, a bagless vacuum cleaner is provided. The bagless vacuum cleaner comprises a main housing, a dust bin releasable from the main housing upon relative movement between the dust bin and the main housing in a release direction, a filter unit, and at least one cleaning member arranged to perform a cleaning action on the filter unit upon relative movement between the at least one cleaning member and the filter unit. The relative movement between the filter unit and the at least one cleaning member is created by relative movement between the main housing and the dust bin in the release direction.

A problem with known filter cleaning arrangements, which has to be actuated by a user, is that they require the user to actively perform a maintenance action. Firstly, that requires the user to actually understand that there is a filter unit in the vacuum cleaner in need of cleaning, which is not always easy, since many vacuum cleaners may have rather hidden filter units. Secondly, when the user knows there is a filter unit to be cleaned, they need to understand how to clean it, which may not always be intuitive in prior art techniques. Thirdly, the user needs to remember and actually care about actuating the cleaning arrangement. These three concerns often result in the filter unit not being cleaned sufficiently often, which reduces the suction force of the vacuum cleaner.

The present aspect is based on an idea of automatically cleaning the filter unit upon removal of the dust bin from the main housing, whereby cleaning of the filter unit is performed each time the dust bin is released from the main housing, such as every time the dust bin is to be emptied by the user. Hence, the cleaning of the filter unit is performed regularly without the user necessarily even knowing that the cleaning action is done. The need of emptying the dust bin may normally be known and intuitive for the user, whereby it usually gets done regularly. The present aspect is advantageous in that it reduces the risk of the filter unit being clogged by dust, which would impair the suction force. Hence, the risk of low performance of the vacuum cleaner due to impaired suction force is reduced.

As the relative movement between the filter unit and the at least one cleaning member is created by the relative movement between the main housing and the dust bin in the release direction, no motor and motor transmission means are required, which reduces the complexity of the vacuum cleaner.

For example, movement of the main housing or the dust bin in the release direction may be transmitted to one of the filter unit and the at least one cleaning member, thereby creating the relative movement between the filter unit and the at least one cleaning member.

According to an embodiment, performing the cleaning action may comprise exerting at least one impulsive force on the filter unit for dislodging dust there from. The impulsive force may be created by the cleaning members engaging the filter unit. The present embodiment enables dislodging dust adhered to soft filter material.

According to an embodiment, the filter unit may comprise a non-flat surface, and the at least one cleaning member may be arranged to be swept across and engage with the non-flat surface upon the relative movement between the filter unit and the at least one cleaning member, whereby the cleaning action is performed. Hence, when the filter unit and the at least one cleaning member are relatively moved (upon removal of the dust bin from the main housing), the cleaning member comes in touch with the non-flat surface as it is swept across it, whereby the filter unit vibrates (shakes). The repeated engagement of the cleaning member with the unevennesses of the non-flat surface causes the cleaning member to exert a repeated impulsive force on the filter unit, whereby dust is dislodges from the filter unit by the resulting vibrations. The non-flat (or uneven) surface may comprises any kind of unevennesses, which may be regular or irregular.

Alternatively (or as a complement), the relative movement between the filter unit and the at least one cleaning member may be constituted by the cleaning members beating (or tapping) the filter. The beating movement may e.g. be created by the at least one cleaning member interacting with (such as runs over) a cam fixed to one of the dust bin and the main housing when the dust bin and main housing are moved relative to each other in the release direction. The cleaning member may e.g. be pivotally suspended such that when one end of the cleaning member runs over the cam, the other end of the cleaning member taps the filter unit.

According to an embodiment, the filter unit may comprise ridges forming said non-flat surface. Hence, the cleaning member may be arranged to run across and engage with the ridges, thereby performing the cleaning action by causing the filter unit to vibrate. In an embodiment, the ridges may extend longitudinally in a direction transverse to the direction of the relative movement between the filter unit and the at least one cleaning member. Hence, when the cleaning member moves, it repeatedly engages (hits) the ridges, thereby performing the cleaning action.

According to an embodiment, the filter unit may comprise a pleated filter comprising the non-flat surface. Hence, the pleats of the filter form the non-flat surface, whereby the non-flat surface is integrated in the filter. Further, the pleats of the filter increase the filter area for the air to pass.

According to an embodiment, the filter unit may comprise a filter and a non-flat element comprising the non-flat surface and being coupled to the filter, whereby movement (such as vibrations) of the non-flat element are transferred to the filter. Thus, the filter vibrates (or shakes) as the cleaning members are swept across the non-flat surface of the non-flat element. With the present embodiment, a flat filter may optionally be used, as the non-flat surface is comprised in the non-flat element.

According to an embodiment, the at least one cleaning member may be secured (such as fixed) to the main housing and the filter unit may be secured (such as fixed) to the dust bin, whereby movement of the main housing is directly transmitted to the cleaning member and movement of the dust bin is directly transmitted to the filter unit. Alternatively, the at least one cleaning member may be secured to the dust bin and the filter unit may be secured to the main housing. Hence, when the main housing and the dust bin are moved relative to each other, the cleaning member and the filter unit are consequently also moved relative to each other.

According to an embodiment, the at least one cleaning member may be movably mounted to the filter unit and the main housing may comprise an engagement element arranged to engage with the cleaning member upon relative movement between the main housing and the dust bin, whereby movement of the main housing is transmitted to the cleaning member, which in result moves relative to the filter unit.

According to an embodiment, the bagless vacuum cleaner may further comprise a coarse filter unit arranged on an upstream side of the filter unit. Hence, the airflow is filtered from coarse particles/subjects (debris) before it is filtered by the filter unit, thereby reducing the debris load on the filter unit, which reduces the required frequency of cleaning of the filter unit. The filter unit may optionally comprise a fine filter.

According to an embodiment, the bagless vacuum cleaner may further comprise a compartment at least partially defined between the filter unit and the coarse filter unit for gathering dust being dislodged from the filter unit by the cleaning action. The compartment may comprise an outlet for emptying the dislodged dust from the compartment. Thus, dust dislodged from the filter unit may be collected in the compartment upon operation of the cleaning member. The compartment may be emptied by the user, e.g. upon emptying the dust bin.

According to an embodiment, the bagless vacuum cleaner may further comprise a lid for sealing an opening of the dust bin and for providing sealing of the outlet of the compartment when the lid is closed. Consequently, when the lid is opened, both the dust bin and the compartment are opened, whereby emptying of the dust bin and the compartment is made simultaneously. The present embodiment is advantageous in that it facilitates emptying of the compartment.

According to an embodiment, the filter unit, the coarse filter unit and the compartment may be comprised in the lid. Further, the outlet (of the compartment) may be arranged at the periphery of the lid such that the outlet is sealed by a rim portion of the dust bin forming the opening when the lid is closed. Thus, when the lid is opened, the outlet of the compartment is uncovered, thereby allowing emptying of the compartment.

According to an embodiment, the dust bin may be coupled to the lid by a hinged connection arranged at the periphery of the lid, and the outlet of the compartment may be arranged at the opposite side of the periphery of the lid compared to the hinged connection. When dust bin is to be emptied, it is preferably turned such that its opening is oriented downwards (e.g. towards a garbage bin). The lid may then be opened, whereby the outlet of the compartment automatically also faces downwards (e.g. towards the garbage bin). The present embodiment is advantageous in that it facilitates emptying of the compartment, as it is made automatically upon emptying of the dust bin.

According to an alternative embodiment, the compartment may be arranged at least partially within the dust bin, and the lid may be arranged to seal the outlet of the compartment. The outlet of the compartment may preferably be substantially aligned with the opening of the dust bin such that the lid also seals the outlet of the compartment when it seals the opening of the dust bin. Preferably, the opening of the dust bin and the outlet of the compartment may be oriented to face in substantially the same direction. The present embodiment is advantageous in that the compartment and dust bin may be emptied simultaneously, which facilitates the emptying action.

According to an embodiment, the release direction may be a rotational direction. For example, the dust bin may be threaded to the main housing, whereby the dust bin may be released by screwing it off the main housing. Alternatively, the release direction may be a translational direction. For example, the dust bin may be arranged at least partially inside the main housing and be released there from by pulling it out of main housing.

According to an embodiment, the bagless vacuum cleaner may be adapted to be powered by a battery. The problem of impaired suction force due to a poorly cleaned filter unit is even more apparent in battery powered bagless vacuum cleaners, as the suction force is reduced due to the limited available power. Therefore, the suction force quickly drops when the filter unit gets clogged. The present embodiment is advantageous in that cleaning of the filter is facilitated in the battery powered vacuum cleaner, as it may be made automatically each time the dust bin is released from the main housing.

It is noted that embodiments of the invention relates to all possible combinations of features recited in the claims.

BRIEF DESCRIPTION OF THE DRAWINGS

This and other aspects will now be described in more detail in the following illustrative and non-limiting detailed description of embodiments, with reference to the appended drawings.

All the figures are schematic, not necessarily to scale, and generally only show parts which are necessary in order to elucidate the embodiments, wherein other parts may be omitted. Like reference numerals refer to like elements throughout the description.

DETAILED DESCRIPTION OF EMBODIMENTS

Figure 1:
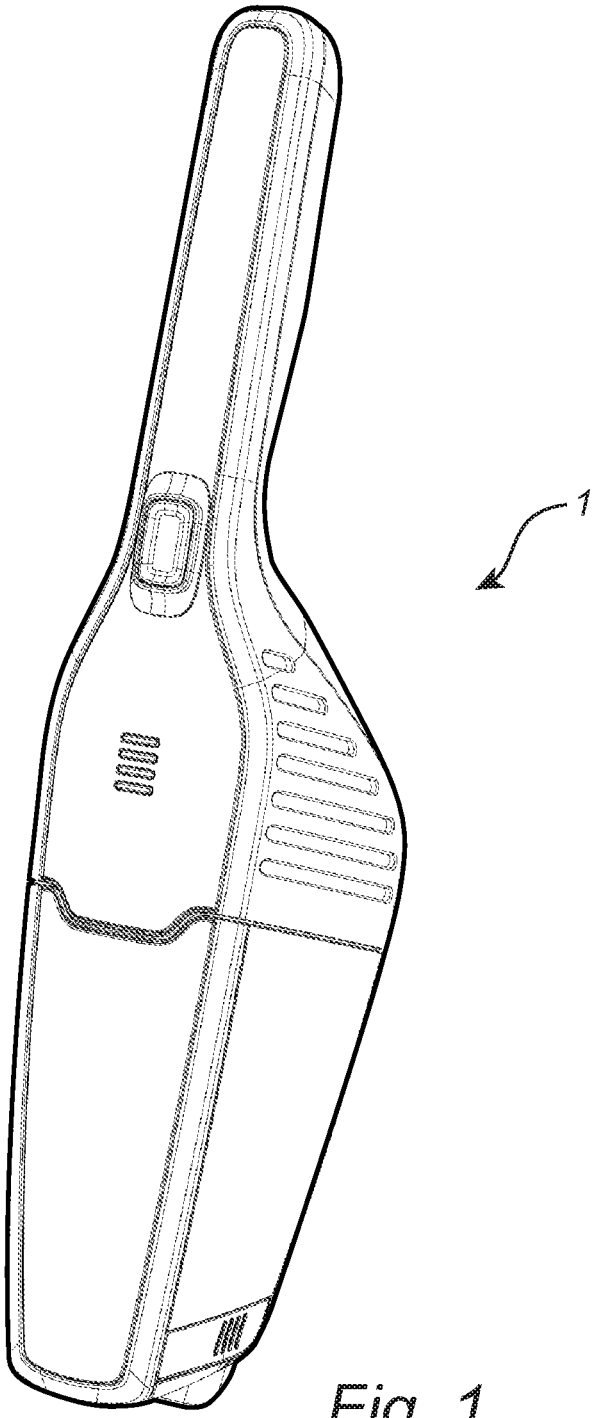
FIG. 1 shows a bagless vacuum cleaner according to an embodiment.

FIG. 1 shows a bagless vacuum cleaner 1 according to an embodiment. The bagless vacuum cleaner 1 may be battery driven or connectable to the mains via a cord. The vacuum cleaner 1 comprises a filter unit and a filter cleaning arrangement, which will be described in more detail with reference to FIGS. 2 and 3 in the following.

The vacuum cleaner comprises a dust bin 120 for collecting dust and debris picked up by the vacuum cleaner. The dust bin 120 comprises an inlet 121 for coupling to the nozzle of the vacuum cleaner. The vacuum cleaner further comprises a filter unit 130 comprising a frame 135 and a pleated filter 131 supported in the frame 135. The filter 131 may e.g. be a fine filter adapted to filter out relatively fine dust particles. In the present example, the filter unit 130 is arranged in a lid 125 of the dust bin 120. The lid 125 is arranged to seal an opening 122 of the dust bin 120 for enabling emptying of the dust bin 120. The lid 125 may be hinged at the dust bin opening 122 by means of a hinge 128. A lock mechanism 126, 127 may be arranged to fix the lid 125 in a closed position, in which the lid 125 seals the opening of the dust bin 120. Alternatively, the lid 125 may be detachably coupled to the dust bin 120 by means of any other suitable attachment means, such as a snap fit mechanism or threads.

Figure 2:
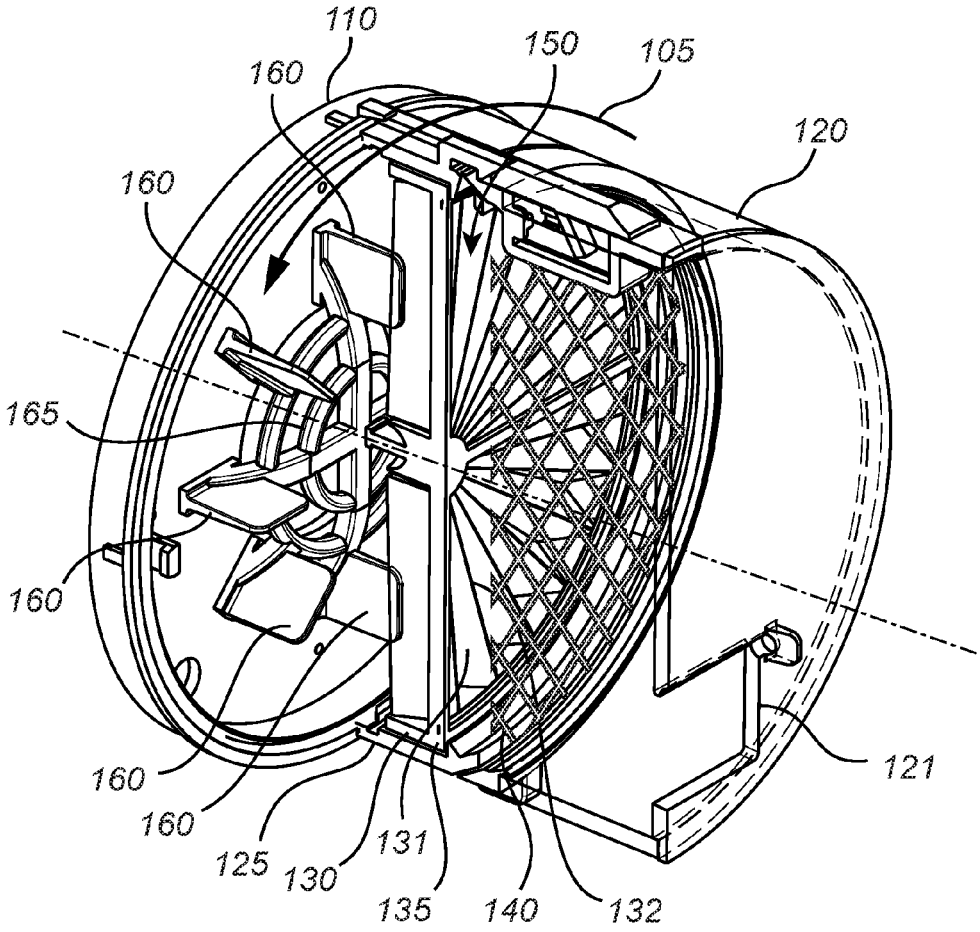
FIG. 2 shows a cross-section of a dust bin attached to a main body and a filter cleaning arrangement according to an embodiment.
Figure 3:
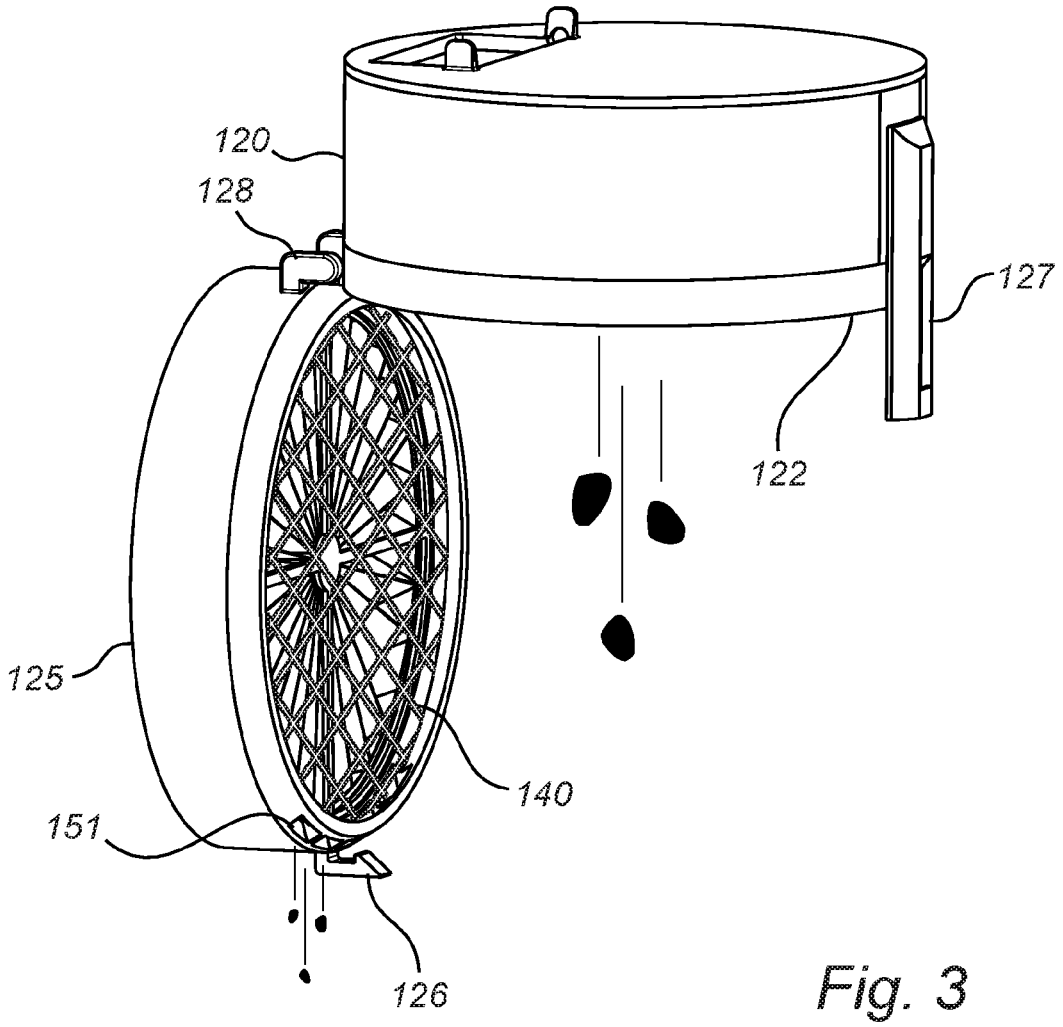
FIG. 3 shows emptying of the dust bin shown in FIG. 2.

Further, a coarse filter unit 140 may be arranged on an upstream side of the filter unit 130, such as in the lid 125 of the dust bin 120. For the sake of clarity, the coarse filter 140 is illustrated in FIGS. 2 and 3 as a wide-meshed grid for revealing the pleated filter 131 behind the coarse filter 141. In practice, the coarse filter 141, may have a significantly smaller sized mesh, such as not even visibly distinct. The coarse filter unit 140 is adapted to filter out relatively coarse particles, such as debris, from the airflow before the airflow is filtered by the filter unit 130. In the present example, the coarse filter unit 140 and the filter unit 130 together enclose (define) a compartment 150 in the lid 125 of the dust bin 120. One or more outlets 151 in the form of apertures are arranged in the lid 125 for enabling emptying of the compartment 150. The outlets 151 may e.g. be arranged at the rim of the lid 125 such that the outlets 151 are sealed by a portion of the rim of the dust bin 120 forming the opening 122 when the lid 125 is in the closed position. Preferably, the outlet 151 may be arranged on the opposite side of the lid 125 compared to the hinge 128.

The vacuum cleaner further comprises a main body 110, a portion of which is illustrated in FIG. 2. The main body 110 may accommodate inter alia a motor and fan unit (not shown) for generating airflow in the vacuum cleaner for providing a suction force. The vacuum cleaner further comprises one or more cleaning members 160. In the present example, the cleaning members 160 are fixed to the main housing 110. The cleaning members 160 may e.g. be fixed to a protection grille 165 arranged at an aperture in the main body 110 for enabling the motor and fan unit to draw air from the dust bin 120. However, the cleaning members 160 may be secured to the main body 110 at any appropriate location. The cleaning members 160 may be formed by flanges, ribs or any other members protruding from the main body 110.

The pleats of the filter 131 form ridges and a non-flat surface of the filter unit 130 facing towards the cleaning members 160 at the main body 110 of the vacuum cleaner. The height of the cleaning members 160 is adapted such that, when the dust bin 120 is attached to the main body 110, the cleaning members 160 partially overlap the pleats of the filter 131 for enabling the cleaning members 160 to engage with the pleats of the filter 131.

The dust bin 120 is detachably mounted to the main body 110 and releasable there from by relative movement between the dust bin 120 and the main body 110 in a release direction 105. In the present example, the dust bin 120 is mounted to the main body 110 by a bayonet like coupling arranged to make the dust bin 120 releasable from the main body 110 by first turning the dust bin 120 (such as about a quarter or a half revolution) in the release direction 105 and then pulling it in a direction away from the main body 110. Hence, in the present example, the release direction 105 is a rotational direction.

According to another example, the dust bin may be threaded onto the main body (not shown) and thereby be released there from by a rotational movement relative to the main body. Alternatively, the dust bin may be arranged at least partially inside a compartment of the main body and be released there from by being pulled out of the compartment of the main body, whereby the release direction is a translational direction.

The ridges formed by the pleats of the filter 131 may preferably extend longitudinally in a direction transverse to the release direction 105. In the present example, the pleats of the filter 131 longitudinally extend in a radial direction and, thus, transverse to the rotational release direction 105.

In the following, the function of the filter cleaning mechanism will be described. When the vacuum cleaner operates, the filter 131 of the filter unit 130 will gradually be filled (clogged) with dust filtered out from the airflow. In particular, the filter 131 of the filter unit 130 may be filled with relatively fine dust, as more coarse particles may have been filtered out by the coarse filter unit 140. Eventually, the dust captured by the filter 131 may gradually reduce the airflow and thereby the suction force of the vacuum cleaner. If the filter unit 130 is not cleaned in time, the suction force may be impaired resulting in impaired cleaning performance of the vacuum cleaner. Further, the dust bin 120 will be gradually filled with dust and debris picked up by the vacuum cleaner. Eventually, the dust bin 120 will have to be emptied from dust and debris by the user. The user then releases the dust bin 120 from the main body 110 by rotating the dust bin 120 relative the main housing 110 in the release direction 105, as illustrated in FIG. 2. When the dust bin 120 and the main housing 110 are moved relative to each other in the release direction 105, a relative movement between the cleaning members 160 and the filter unit 130 is consequently created since the cleaning members 160 are fixed to the main housing 110 and the filter unit 130 is fixed to the dust bin 120.

When the cleaning members 160 move relative to the filter unit 130, the cleaning members 160 engage with the pleats of the filter 131. The cleaning members 160 perform a cleaning action when they are swept across the pleats of the filter 131, thereby exerting a repeated impulsive force on the filter unit 130 causing the filter 131 to vibrate or shake, which in turn causes dust adhered to the filter 131 to dislodge. The dislodged dust ends up in the compartment 150 between the filter unit 130 and the coarse filter unit 140.

When the user shall empty the dust bin 120, he/she may orient the dust bin 120 such that the opening 122 is directed downwards (e.g. over a garbage bin) and open the lid 120 such that the dust and debris in the dust bin 120 fall out. When the lid 125 is opened, the outlet 151 is unsealed and automatically turned downwards by the force of gravity such that the dislodged dust falls out of the compartment 150. Hence, the dust captured in the dust bin 120 and the dust dislodged from the filter unit 130 may be disposed at the same time.

When the dust has been removed from the filter unit 130 by the cleaning action, the original suction force is substantially restored. As the cleaning action is performed each time the dust bin 120 is released from the main body 110, which is done at least each time the dust bin 120 has to be emptied, the filter unit 130 is cleaned regularly, whereby the risk of impaired cleaning performance of the vacuum cleaner is reduced.

A vacuum cleaner according to another embodiment will be described with reference 4 in the following. The vacuum cleaner according to the present embodiment may be similarly configured as the vacuum cleaner described with reference to FIGS. 1 to 3.

Figure 4:
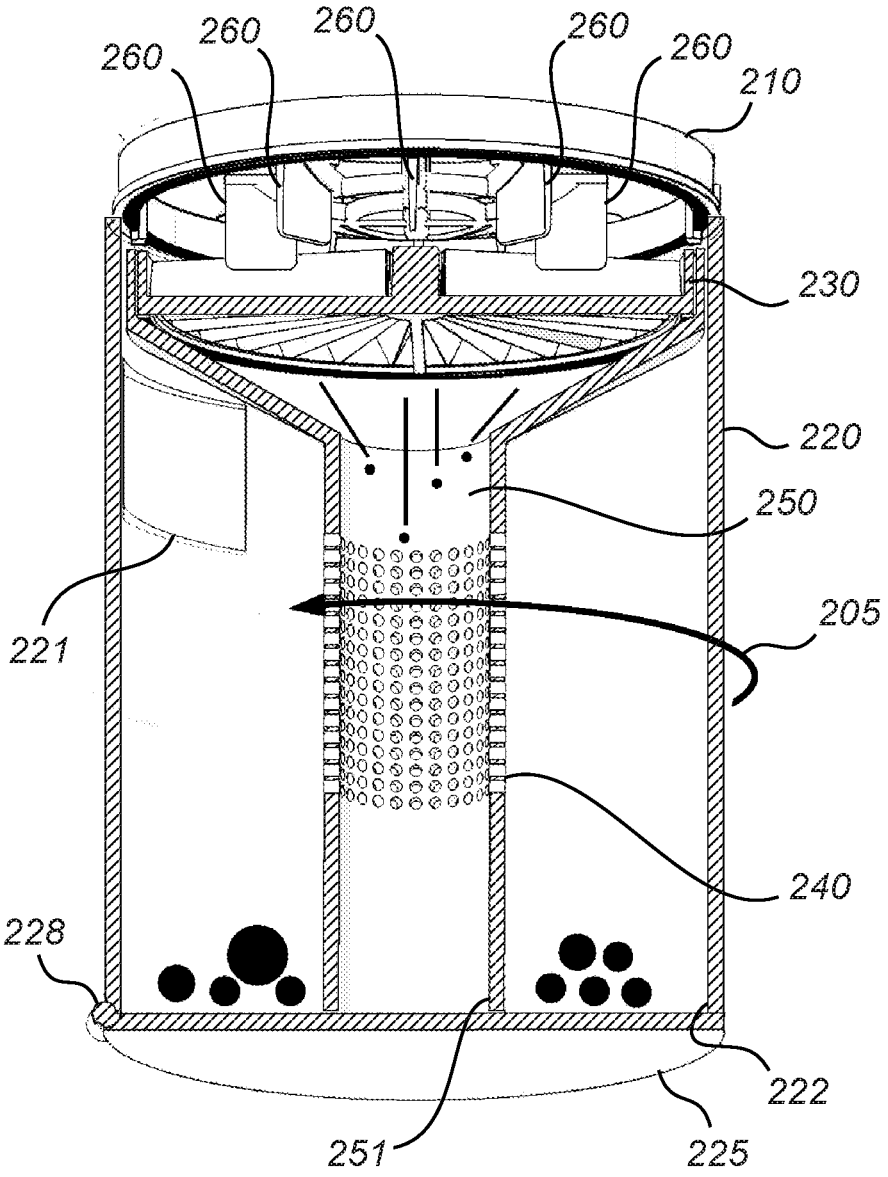
FIG. 4 shows a cyclone with a filter cleaning arrangement according to another embodiment.

FIG. 4 shows a portion of the main body 210 of the vacuum cleaner and the dust bin 220 attached to the main body 210. In the present embodiment, the vacuum cleaner may be a cyclone vacuum cleaner, and the dust bin 220, the coarse filter 240 and the filter unit 230 may form a cyclone (or centrifugal separator) for separating dust from the air flow. During operation, the air flow first circulates in the dust bin 220 around the coarse filter 240, whereby coarse particles are separated from the airflow by centrifugal force. The air then flows through the coarse filter 240 and subsequently through the filter unit 230. The cyclone has an air and dust inlet 221 arranged in a wall of the dust bin 220. The filter unit 230 is arranged in the dust bin 220, preferably at the end of the dust bin 220 opposite to the opening 222 of the dust bin 220. The coarse filter unit 240 is also arranged inside the dust bin 220, whereby the compartment 250 defined between the filter unit 230 and the coarse filter unit 240 is consequently also defined inside the dust bin 220. The outlet 251 of the compartment 250 may preferably be aligned with the opening 222 of the dust bin 220, whereby the lid 225 seals both the opening 222 of the dust bin 220 and the outlet 251 of the compartment 250. Alternatively, the outlet 251 may not be aligned with the opening 222, and the lid 225 may be shaped (e.g. by comprising a protrusion or depression) for sealing both the outlet 251 and the opening 222 (not shown). The lid 225 may e.g. be connected by a hinge 228 to the rim of the dust bin 220 forming the opening 222.

With the present embodiment, the filter cleaning action is performed similarly as in the embodiment described with reference to FIGS. 2 and 3, namely by rotating the dust bin 220 in the release direction 205, whereby the cleaning members 260 are swept across and engages with the pleats of the filter unit 230 for performing the cleaning action. Dust is dislodged from the filter unit 230 and ends up in the compartment 250. When the lid 225 is opened, dust from the compartment 250 may be discharged simultaneously as dust from the dust bin 220.

Figure 5:
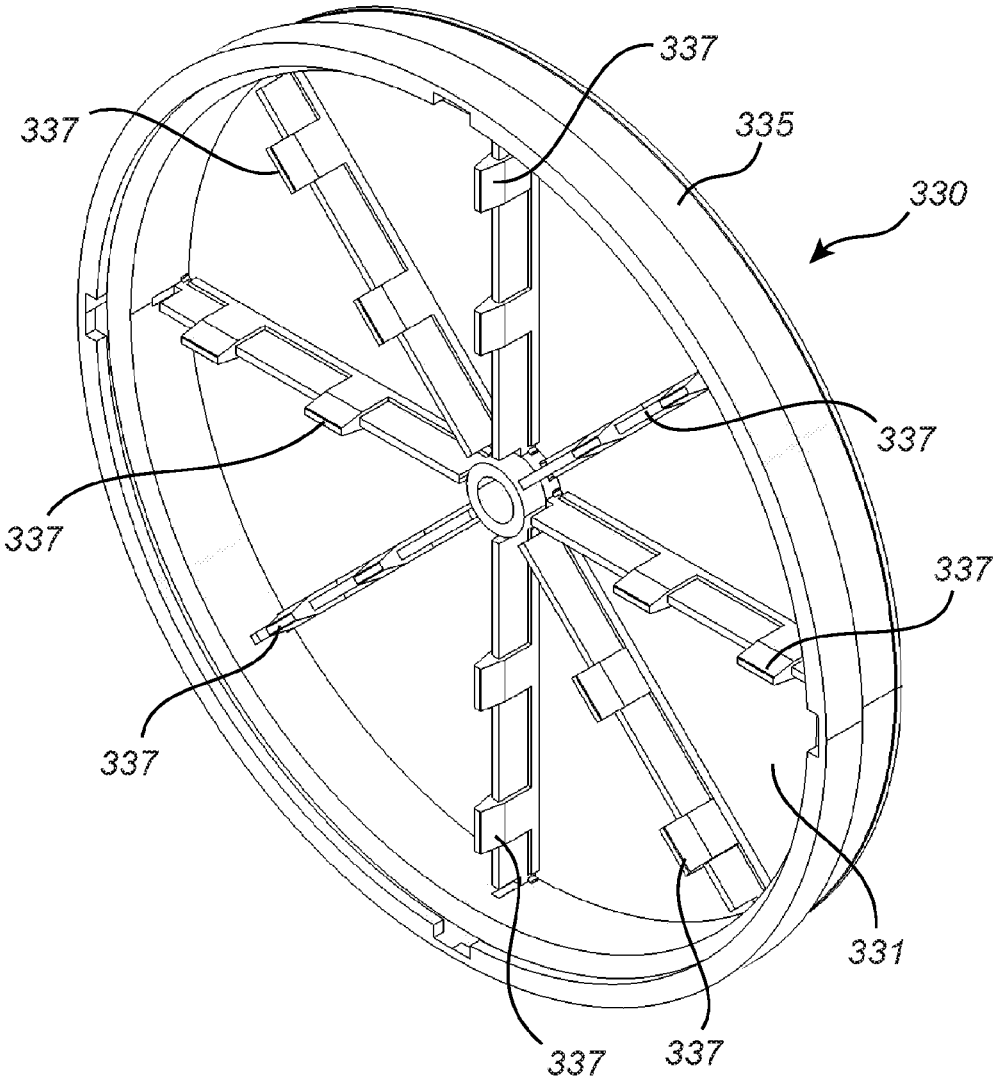
FIG. 5 shows a filter unit according to an embodiment.

It will be appreciated that the non-flat surface of the filter unit may be configured in various manners. FIG. 5 shows a filter unit 330 according to an embodiment. In the present embodiment, the filter unit 330 comprises a substantially flat filter 331 arranged in a frame 335. The non-flat surface of the filter unit 330 is formed by a non-flat element comprising a plurality of ridges 337. For example, the ridges 337 may longitudinally extend radially in the frame 335, such as from a center portion towards a rim of the filter unit 330. The cleaning action may be performed by the cleaning members (not shown) being swept across the ridges, thereby repeatedly exerting an impulsive force on the filter unit 230 for dislodging dust there from.

In the above described embodiments, the cleaning members are fixed to the main housing and the filter unit is fixed to the dust bin. However, it will be appreciated that the filter unit instead may be fixed to the main housing and the cleaning members may be fixed to the dust bin. Other configurations may also be envisaged for transferring relative movement between the dust bin and the main housing to relative movement between the cleaning members and the filter unit. For example, the cleaning members may be movably (such as rotatably) attached to the filter unit, wherein an engagement element (such as a protruding portion) of the main housing may be arranged to keep the cleaning members still relative to the main housing upon relative movement between the main housing and the dust bin. According to another example, the cleaning members may be arranged to, at a first end, engage with a non-flat cam e.g. attached to the main housing, and to, at a second end, tap the filter unit when the first end runs over the cam upon relative movement between the main housing and the dust bin. Thus, the cleaning members tap the filter upon relative movement between the main housing and the dust bin.

The person skilled in the art realizes that the present invention by no means is limited to the embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A bagless vacuum cleaner comprising:

a main housing;

a dust bin releasable from the main housing upon relative movement between the dust bin and the main housing in a release direction;

a filter unit;

a coarse filter unit arranged on an upstream side of the filter unit;

a compartment at least partially defined between the filter unit and the coarse filter unit for gathering dust being dislodged from the filter unit by the cleaning action, the compartment having an outlet for emptying the dislodged dust from the compartment; and at least one cleaning member arranged to perform a cleaning action on the filter unit upon relative movement between the at least one cleaning member and the filter unit;

wherein the relative movement between the filter unit and the at least one cleaning member is created by relative movement between the main housing and the dust bin in the release direction.

2. The bagless vacuum cleaner as defined in claim 1, wherein performing the cleaning action comprises exerting at least one impulsive force on the filter unit for dislodging dust there from.

3. The bagless vacuum cleaner as defined in claim 1, wherein the filter unit comprises a non-flat surface, and wherein the at least one cleaning member is arranged to be swept across and engage with the non-flat surface upon the relative movement between the filter unit and the at least one cleaning member, thereby performing the cleaning action.

4. The bagless vacuum cleaner as defined in claim 3, wherein the filter unit comprises ridges forming the non-flat surface.

5. The bagless vacuum cleaner as defined in claim 4, wherein the ridges extends longitudinally in a direction transverse to the direction of the relative movement between the filter unit and the at least one cleaning member.

6. The bagless vacuum cleaner as defined in claim 3, wherein the filter unit comprises a pleated filter comprising the non-flat surface.

7. The bagless vacuum cleaner as defined in claim 3, wherein the filter unit comprises a filter and a non-flat element comprising the non-flat surface and being coupled to the filter.

8. The bagless vacuum cleaner as defined in claim 1, wherein the at least one cleaning member is secured to the main housing and the filter unit is secured to the dust bin.

9. The bagless vacuum cleaner as defined in claim 1, wherein the at least one cleaning member is secured to the dust bin and the filter unit is secured to the main housing.

10. The bagless vacuum cleaner as defined in claim 1, wherein the at least one cleaning member is movably mounted to the filter unit, and wherein the main housing comprises an engagement element arranged to engage with the cleaning member upon relative movement between the main housing and the dust bin.

11. The bagless vacuum cleaner as defined in claim 1, further comprising a lid for sealing an opening of the dust bin and for providing sealing of the outlet of the compartment when the lid is closed.

12. The bagless vacuum cleaner as defined in claim 11, wherein the filter unit, the coarse filter unit and the compartment are in the lid, and wherein the outlet is arranged at the periphery of the lid such that the outlet is sealed when the lid is closed by a rim portion of the dust bin forming the opening.

13. The bagless vacuum cleaner as defined in claim 12, wherein the dust bin is coupled to the lid by a hinged connection arranged at the periphery of the lid, and wherein the outlet of the compartment is arranged at the opposite side of the periphery of the lid compared to the hinged connection.

14. The bagless vacuum cleaner as defined in claim 11, wherein the compartment is arranged at least partially within the dust bin, and wherein the lid is arranged to seal the outlet of the compartment.

15. The bagless vacuum cleaner as defined claim 1, wherein the release direction is a rotational direction.

16. The bagless vacuum cleaner as defined in claim 1, wherein the release direction is a translational direction.

17. The bagless vacuum cleaner as defined in claim 1, wherein the bagless vacuum cleaner is adapted to be powered by a battery.

* * * * *